US011654686B2

(12) United States Patent
Onishi et al.

(10) Patent No.: US 11,654,686 B2
(45) Date of Patent: May 23, 2023

(54) LIQUID CONTAINER, LIQUID SUPPLY DEVICE AND LIQUID DISCHARGE APPARATUS

(71) Applicant: KYOCERA Document Solutions Inc., Osaka (JP)

(72) Inventors: Yuzo Onishi, Osaka (JP); Masanobu Maeshima, Osaka (JP); Masahiro Kashimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 79 days.

(21) Appl. No.: 17/375,107

(22) Filed: Jul. 14, 2021

(65) Prior Publication Data

US 2022/0016890 A1 Jan. 20, 2022

(30) Foreign Application Priority Data

Jul. 15, 2020 (JP) ..... JP2020-121311
Jul. 8, 2021 (JP) ..... JP2021-113480

(51) Int. Cl.
*B41J 2/175* (2006.01)
*B41J 2/135* (2006.01)

(52) U.S. Cl.
CPC ..... *B41J 2/17503* (2013.01); *B41J 2/135* (2013.01)

(58) Field of Classification Search
CPC ..... B41J 2/17503; B41J 2/135; B41J 2002/17516; B41J 2/17513; B41J 29/13; B41J 2/175
USPC ..... 347/86
See application file for complete search history.

(56) References Cited

U.S. PATENT DOCUMENTS

2005/0057625 A1* 3/2005 Ishizawa ..... B41J 2/17559 347/86
2006/0038864 A1* 2/2006 Konishi ..... B41J 2/17513 347/86

FOREIGN PATENT DOCUMENTS

JP 2016-107417 A 6/2016

* cited by examiner

*Primary Examiner* — Matthew Luu
*Assistant Examiner* — Alexander D Shenderov
(74) *Attorney, Agent, or Firm* — Studebaker & Brackett PC

(57) ABSTRACT

A liquid container includes a pack main body and a covering body. The covering body covers a part of the pack main body and is more hardly deformable than the pack main body. The pack main body includes a trunk part, a pair of sealing parts and a spout. The trunk part is formed into a rectangular cylindrical shape in a state where the ink is stored. The pair of sealing parts seal both ends of the trunk part. At least one of the sealing parts is formed into a gabled roof shape having a pair of flat portions facing each other in the thickness direction and a pair of gable portions facing each other in a width direction. The covering body includes a pair of covering flat plates covering at least a part of the pair of flat portions.

16 Claims, 8 Drawing Sheets

LIQUID CONTAINER, LIQUID SUPPLY DEVICE AND LIQUID DISCHARGE APPARATUS

INCORPORATION BY REFERENCE

This application is based on and claims the benefit of priority from Japanese patent application Nos. 2020-121311 filed on Jul. 15, 2020 and 2021-113480 filed on Jul. 8, 2021 which are incorporated by reference in its entirety.

BACKGROUND

The present disclosure relates to a liquid container, a liquid supply device and a liquid discharge apparatus.

An ink pack in which an ink used for an inkjet printer is stored is known. The ink pack is formed in a back shape made of film material, and stored in a case of an ink storage part in a replaceable manner. The ink pack has a spout serving as an ink supply port (to the inkjet head), and the thickness of the ink pack is gradually changed (the ink pack is collapsed in a flat shape) depending on a consumed amount of the ink.

However, since the ink pack made of film material is easily deformed (bent or recessed) by an external force, it is sometimes stored in the case in a deformed state. In this case, there is a problem that the ink remains in the ink pack because it is not collapsed in a flat shape at the deformed portion in the process of being collapsed depending on the consumed amount of the ink.

SUMMARY

In accordance with an aspect of the present disclosure, a liquid container includes a pack main body and a covering body. The pack main body is formed by bonding flexible films, and changes a thickness depending on a remaining amount of the liquid. The covering body covers a part of the pack main body and is more hardly deformable than the pack main body. The pack main body includes a trunk part, a pair of sealing parts and a spout. The trunk part is formed into a rectangular cylindrical shape in a state where the ink is stored. The pair of sealing parts seal both ends of the trunk part in an axial direction. The spout is provided in one of the sealing parts, and through which the liquid stored in the pack main body is discharged. At least one of the sealing parts is formed into a gabled roof shape having a pair of flat portions facing each other in a thickness direction and a pair of gable portions facing each other in a width direction perpendicular to the axial direction and the thickness direction. The covering body includes a pair of covering flat plates covering at least a part of the pair of flat portions.

In accordance with an aspect of the present disclosure, a liquid supply device includes the liquid container and supplies the liquid stored in the liquid container to a supply destination.

In accordance with an aspect of the present disclosure, a liquid discharge apparatus includes the liquid container and a discharge head through which the liquid supplied from the liquid container is discharged.

The other features and advantages of the present disclosure will become more apparent from the following description. In the detailed description, reference is made to the accompanying drawings, and preferred embodiments of the present disclosure are shown by way of example in the accompanying drawings.

DETAILED DESCRIPTION

Hereinafter, with reference to the attached drawings, the present embodiment of the present disclosure will be described. Fr, Rr, L, R, U and D marked in each figure indicate a front, a rear, a left, a right, an upper and a lower. Although terms showing a direction and a position are used herein, they are used for illustrative purposes and are not intended to limit the scope of the present disclosure.

Figure 1:
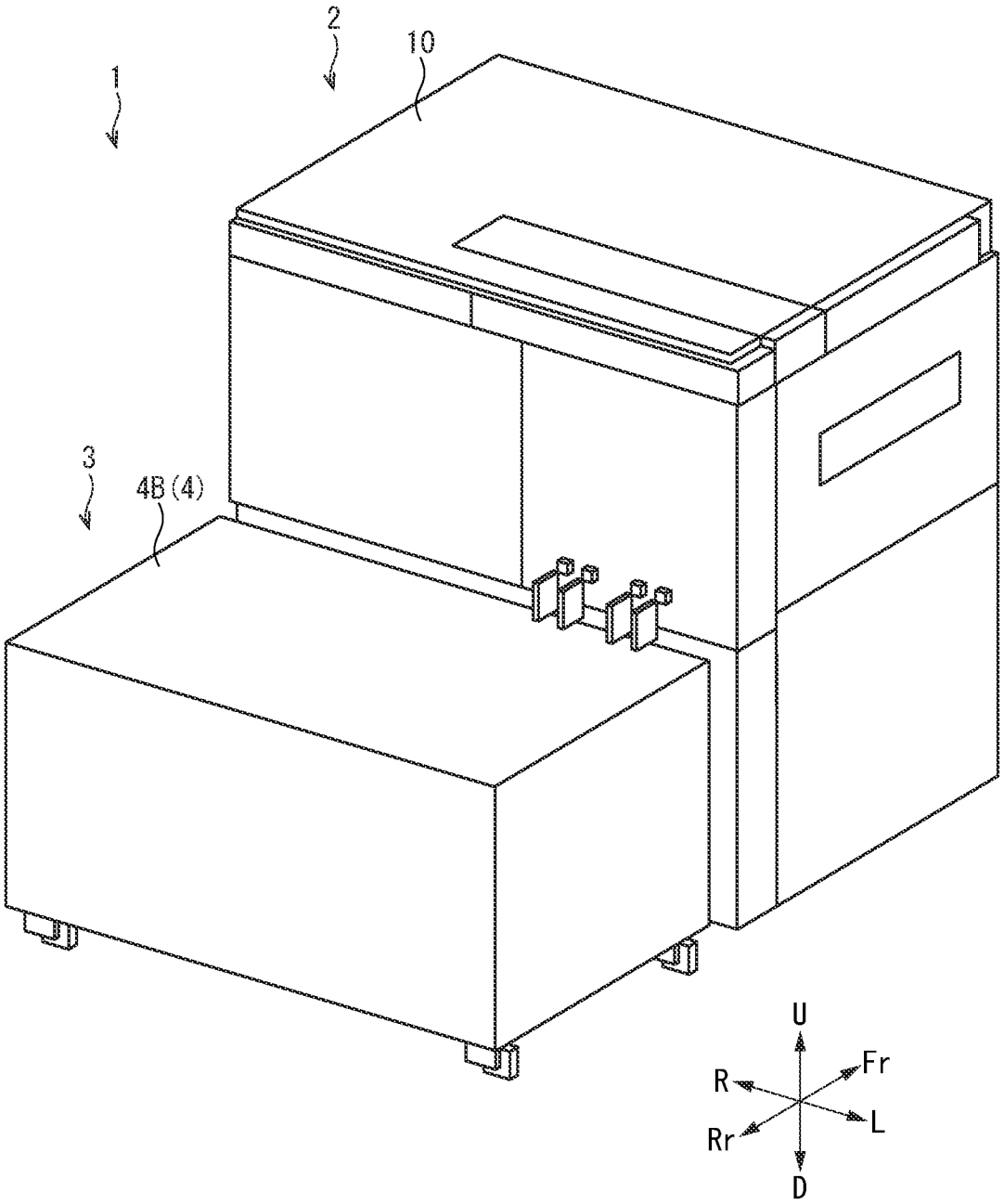
FIG. 1 is a perspective view showing an image forming system according to one embodiment of the present disclosure.

The image forming system 1 will be described with reference to FIG. 1 and FIG. 2. FIG. 1 is a perspective view showing the image forming system 1. FIG. is a front view schematically showing an inner structure of an image forming apparatus 2.

As shown in FIG. 1, the image forming system 1 includes the image forming apparatus 2 and an ink supply device 3. The image forming apparatus 2 as an example of a liquid discharge apparatus is an inkjet printer which discharges ink droplets to form an image on a sheet S. The ink supply device 3 as an example of a liquid supply device is disposed on the rear side of the image forming apparatus 2 and supplies ink (liquid) to the image forming apparatus 2.

Figure 2:
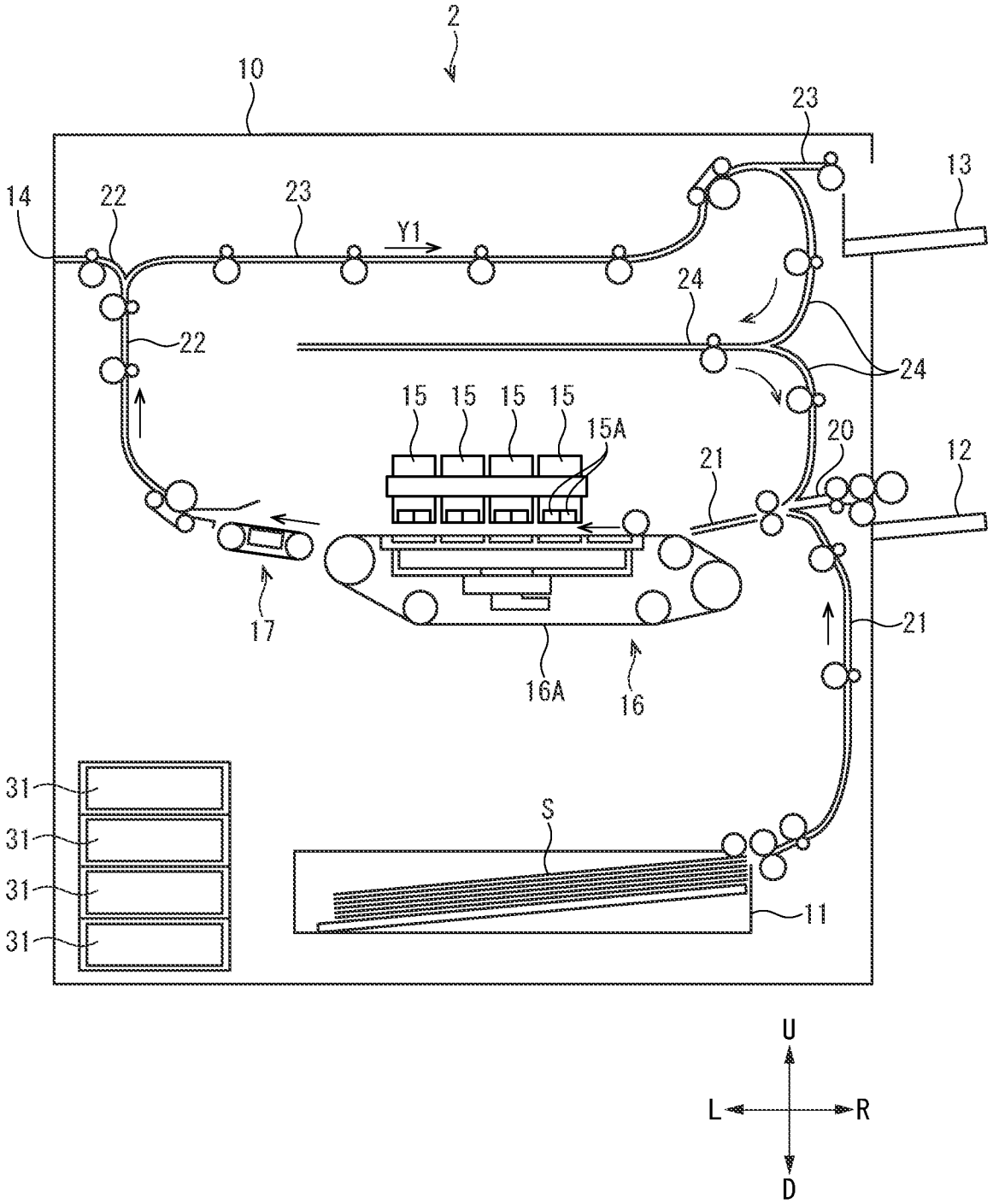
FIG. 2 is a front view schematically showing an inner structure of an image forming apparatus according to the embodiment of the present disclosure.

[Image Forming Apparatus] As shown in FIG. 2, the image forming apparatus 2 includes a box-shaped housing 10 in which various devices are stored. A sheet feeding cassette 11 in which the sheet S is stored is provided in the lower portion of the housing 10, and a manual sheet feeding tray 12 on which the sheet S is manually set is provided on the right side surface of the housing 10. Above the manual sheet feeding tray 12, a sheet discharge tray 13 on which the image-formed sheet S is stacked is provided. In the upper portion of the left side surface of the housing 10, a discharge port 14 through which the sheet S is conveyed to a post-processing apparatus (not shown) disposed on the left side of the image forming apparatus 2 is formed.

In the central portion of the housing 10, four head units 15 which forms an image on the sheet S are disposed side by side in the left-and-right direction. The four head units 15 are disposed corresponding to ink of four colors (yellow, black, cyan and Magenta). Each head unit 15 includes a plurality of discharge heads 15A which discharge the ink. Below the head units 15, a conveyance unit 16 which conveys the sheet S while attracting the sheet S to a conveyance belt 16A is provided. On the left side of the conveyance unit 16, a drying unit 17 which dries the image-formed sheet S while conveying it is provided.

In the lower left portion of the inside of the housing 10, four ink containers 31 storing the ink to be supplied to the four head units 15 (the discharge heads 15A) are stored. Therefore, the image forming apparatus 2 can be used independently without the ink supply device 3 described later.

A first conveyance path 21 from the sheet feeding cassette 11 to the conveyance unit 16 and a manual sheet conveyance path 20 joining from the manual sheet feeding tray 12 to the first conveyance path 21 are provided in the right side portion of the inside of the housing 10. A second conveying path 22 from the drying unit 17 to the discharge port 14 is provided in the left side portion of the inside of the housing 10. Above the head units 15, a third conveyance path 23 branching from the second conveyance path 22 to the sheet discharge tray 13, and a fourth conveyance path 24 branching from the third conveyance path 23 and joining to the first conveyance path 21 are provided. At a branch point between the second conveyance path 22 and the third conveyance path 23 and at a branch point between the third conveyance path 23 and the fourth conveyance path 24, a switching member for switching the conveying path of the sheet S is provided (not shown).

[Image Forming Processing] The image forming processing performed by the image forming apparatus 2 will be described. For example, when an image forming job is input to the image forming apparatus 2 from an external terminal or the like connected to the image forming apparatus 2, the image forming processing is performed as follows.

The sheet S is fed from the sheet feeding cassette 11 or the manual sheet feeding tray 12 and then on the conveyance belt 16A through the first conveyance path 21. The head units 15 (the discharge heads 15A) discharge the ink droplets to the sheet S conveyed while attracted to the conveyance belt 16A, and form (print) a full-color image. The sheet S on which the image is formed is conveyed by the drying unit 17, and drying of the ink landed on the sheet S is promoted during this time. When a one-side printing is performed, the sheet S printed on one face is discharged to the sheet discharge tray 13 through the second conveyance path 22 and the third conveyance path 23. When a both-side printing is performed, the sheet S printed on one face is conveyed along the fourth conveyance path 24, is turned upside down, and is again fed to the conveyance belt 16A. Thereafter, an image is formed on the back face of the sheet S in the same order as in the case of the one-side printing, and the sheet S printed on both faces is discharged to the sheet discharge tray 13.

Figure 3:
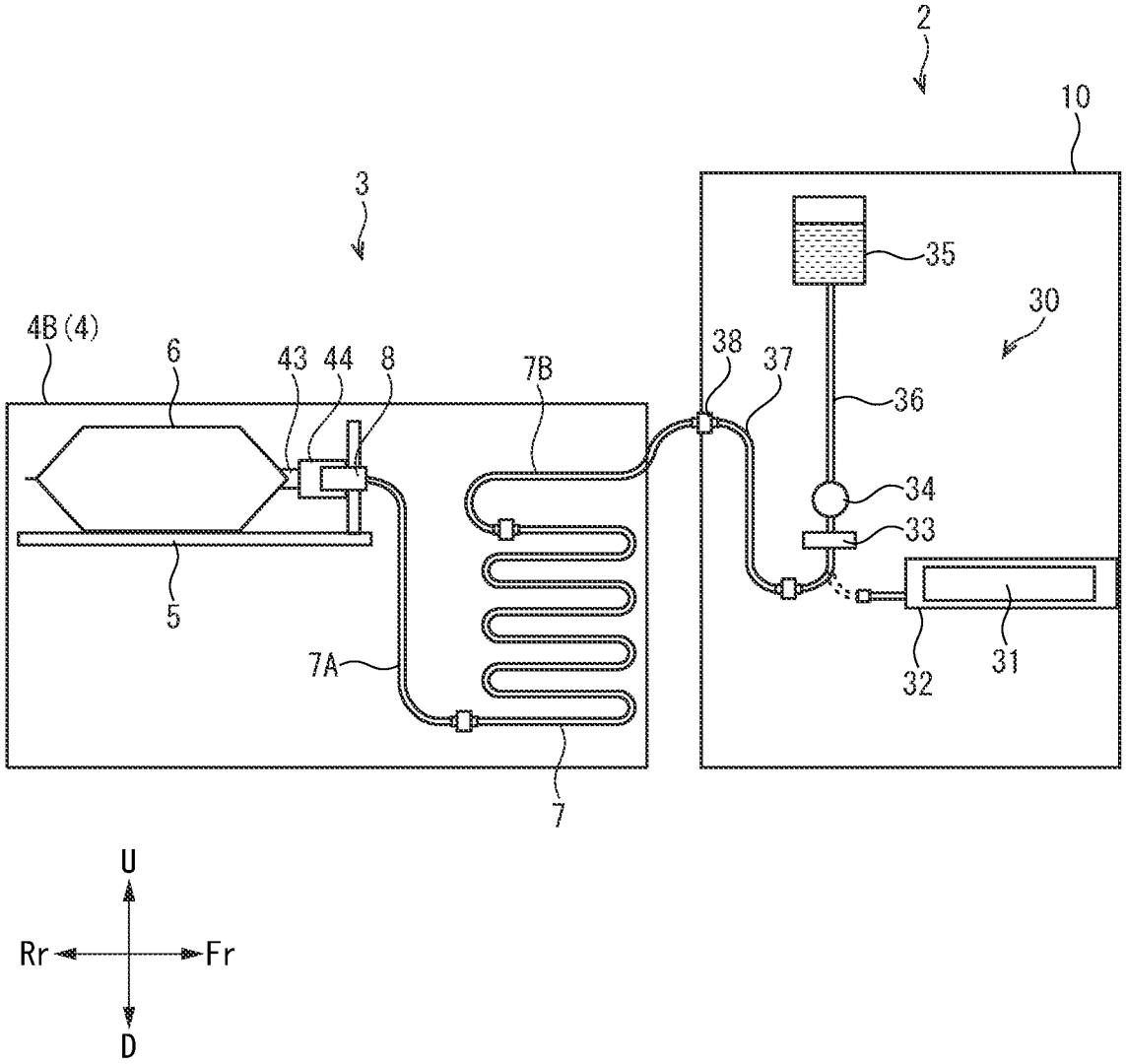
FIG. 3 is a side view schematically showing an ink supply path of the image forming system according to one embodiment of the present disclosure.

[Ink Supply Path] Next, with reference to FIG. 3, the ink supply path of the image forming apparatus 2 will be described. FIG. 3 is a side view schematically showing the ink supply path of the image forming system 1. In the present embodiment, the four ink supply paths are provided for the four colors of the ink, but FIG. 3 shows one ink supply path for one color. Hereinafter, the one ink supply path will be described.

The image forming apparatus 2 includes an ink supply part 30 which supplies the ink to each head unit 15. The ink supply part 30 includes an ink container 31, a container attachment part 32, a filter 33, a pump 34 and a sub tank 35.

The ink container 31 is attached to the container attachment part 32, and stores the ink to be supplied to the corresponding head unit 15. The ink container 31, the filter 33, the pump 34 and the sub tank 35 are connected to each other by a main pipe 36. The pump 34 sucks the ink from the ink container 31, and the filter 33 filters the ink to be sucked by the pump 34. The ink fed from the ink container 31 is stored in the sub tank 35. The sub tank 35 is connected to the corresponding head unit 15 (the discharge head 15A) through a sub pipe (not shown). The ink stored in the sub tank 35 is supplied to the head unit 15 by a sub pump (not shown).

On the back face of the housing 10, a coupling 38 to which one end of a relay pipe 37 is connected is provided. When the ink supply device 3 is used, the upstream end of the main pipe 36 is connected to the other end of the relay pipe 37 in place of the ink container 31.

Figure 4:
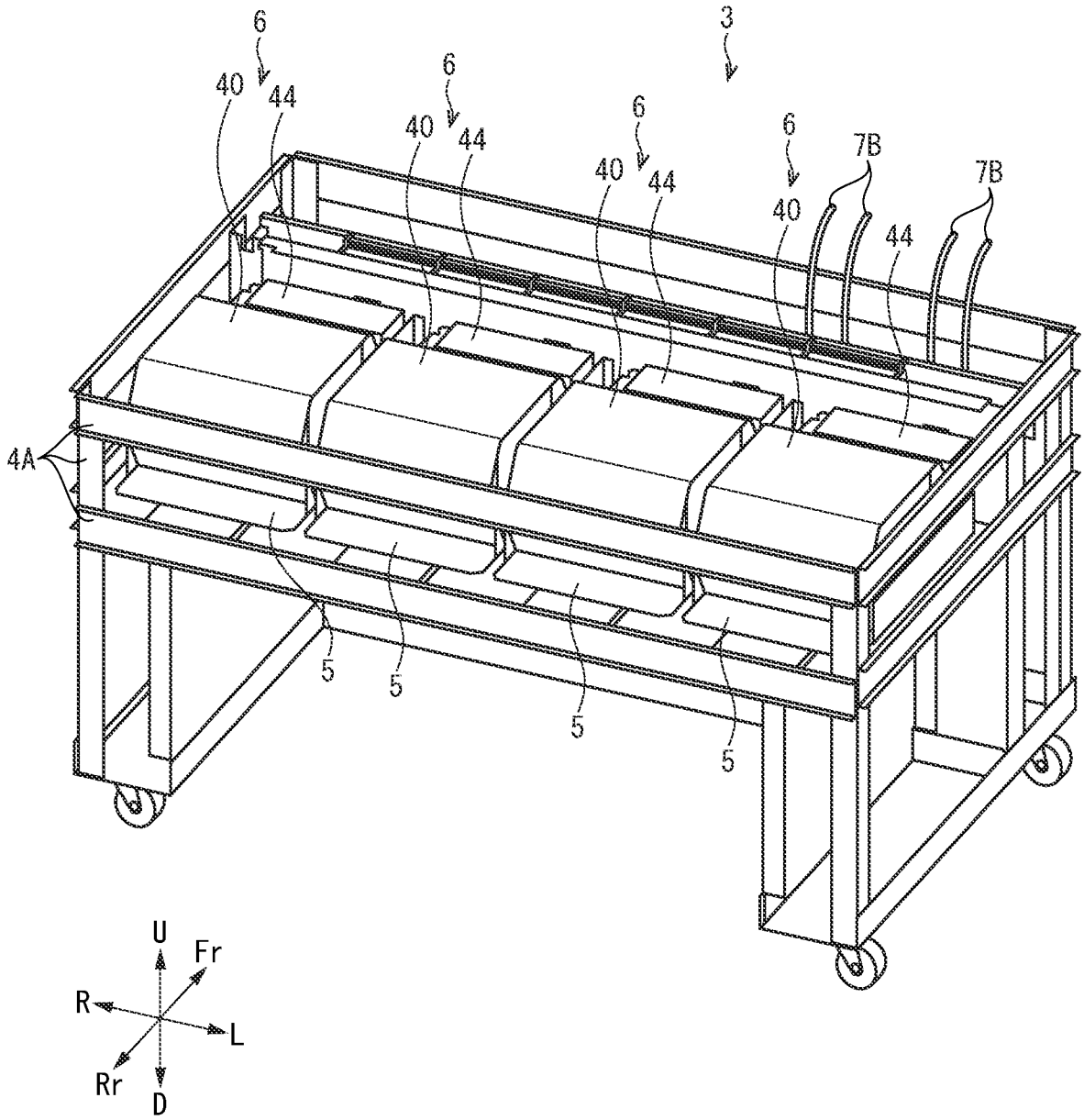
FIG. 4 is a perspective view showing an inner structure of an ink supply device according to the embodiment of the present disclosure.

[Ink Supply Device 3] With reference to FIG. 3 and FIG. 4, the ink supply device 3 will be described. FIG. 4 is a perspective view showing an inner structure of the ink supply device 3.

The ink supply device 3 includes a casing 4, four pack attachment parts 5, four ink packs 6 and four supply pipes 7. In the present embodiment, the four ink packs 6 and the others are provided for the four colors of the ink, but FIG. 3 shows one ink pack 6 and the others. In the following description, one ink pack 6 and the others will be described unless otherwise specified.

The casing 4 includes a frame 4A (see FIG. 4) formed into an approximately parallelepiped shape by assembling metal columns and beams, and exterior plates 4B (see FIG. 1) covering the side faces and the top face of the frame 4A. As shown in FIG. 4, the four pack attachment parts 5 are disposed side by side in the left-and-right direction in the rear portion of the inside of the casing 4. The pack attachment part 5 is formed into an approximate flat plate shape, and supported by the frame 4A.

The ink pack 6 is a container in which the ink is stored. The ink pack 6 has a capacity larger than the ink container 31 attached to the image forming apparatus 2. The ink pack 6 is attached to the pack attachment part 5 in a detachable manner (in a replaceable manner). The ink pack 6 will be described below).

As shown in FIG. 3, the supply pipe 7 is a steel pipe made of stainless steel, for example, and is formed into a regularly meandered shape. One end of the supply pipe 7 is connected to an upstream connection pipe 7A, and the other end of the supply pipe 7 is connected to the coupling 38 of the housing 10 via a downstream connection pipe 7B. To a terminal end of the upstream connection pipe 7A, a suction port member 8 is mounted. The suction port member 8 is fixed to the pack attachment part 5, and is connected to a supply connection part 44 of the ink pack 6 attached to the pack attachment part 5. The ink filled in the ink pack 6 is supplied to the ink supply path in the image forming apparatus 2 through the suction port member 8, the upstream connection pipe 7A, the supply pipe 7 and the downstream connection pipe 7B. The ink supply device 4 is provided with a heater (not shown) which heats the ink passing through the supply pipe 7.

Figure 5:
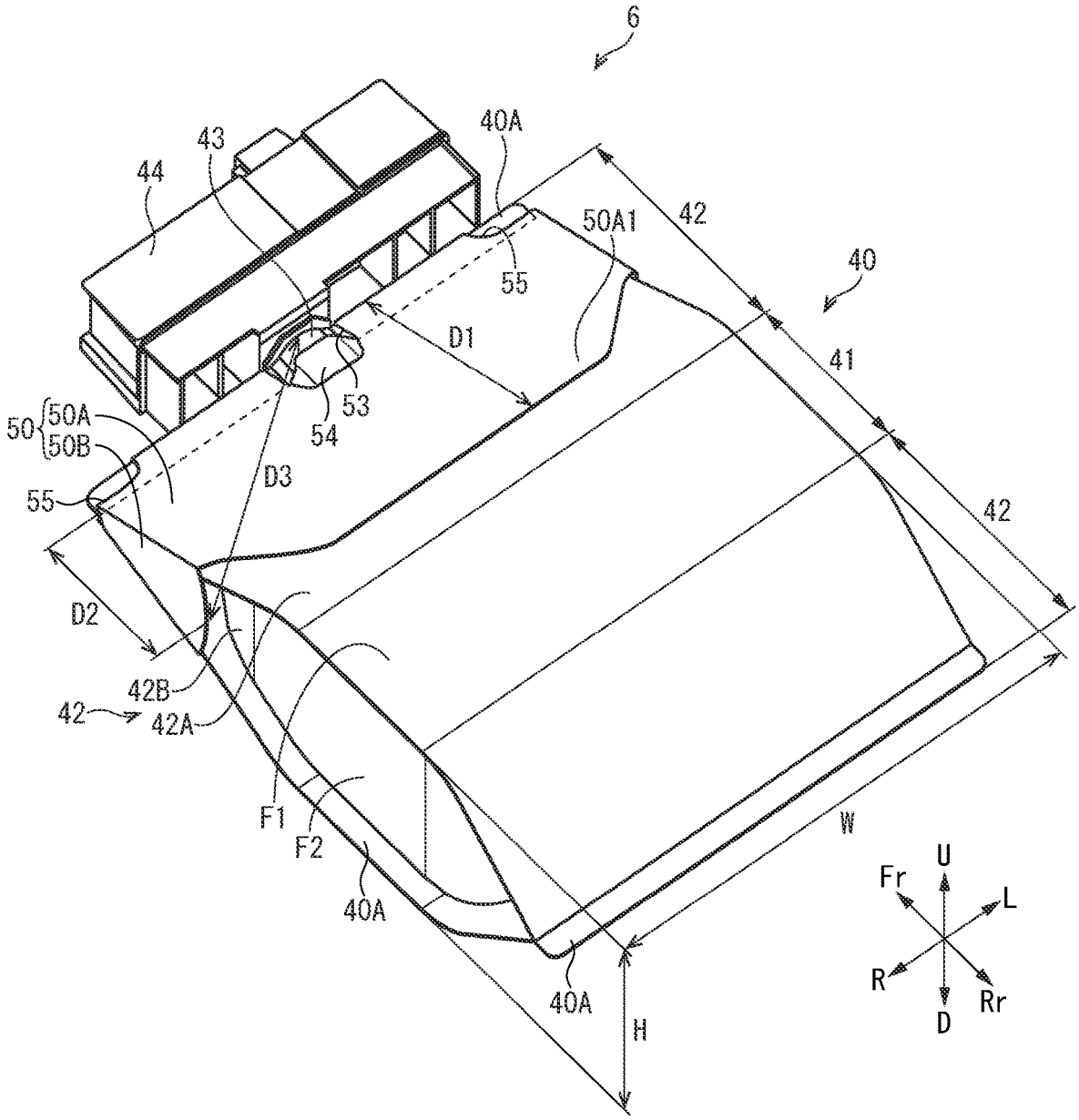
FIG. 5 is a perspective view showing an ink pack according to the embodiment of the present disclosure.
Figure 6:
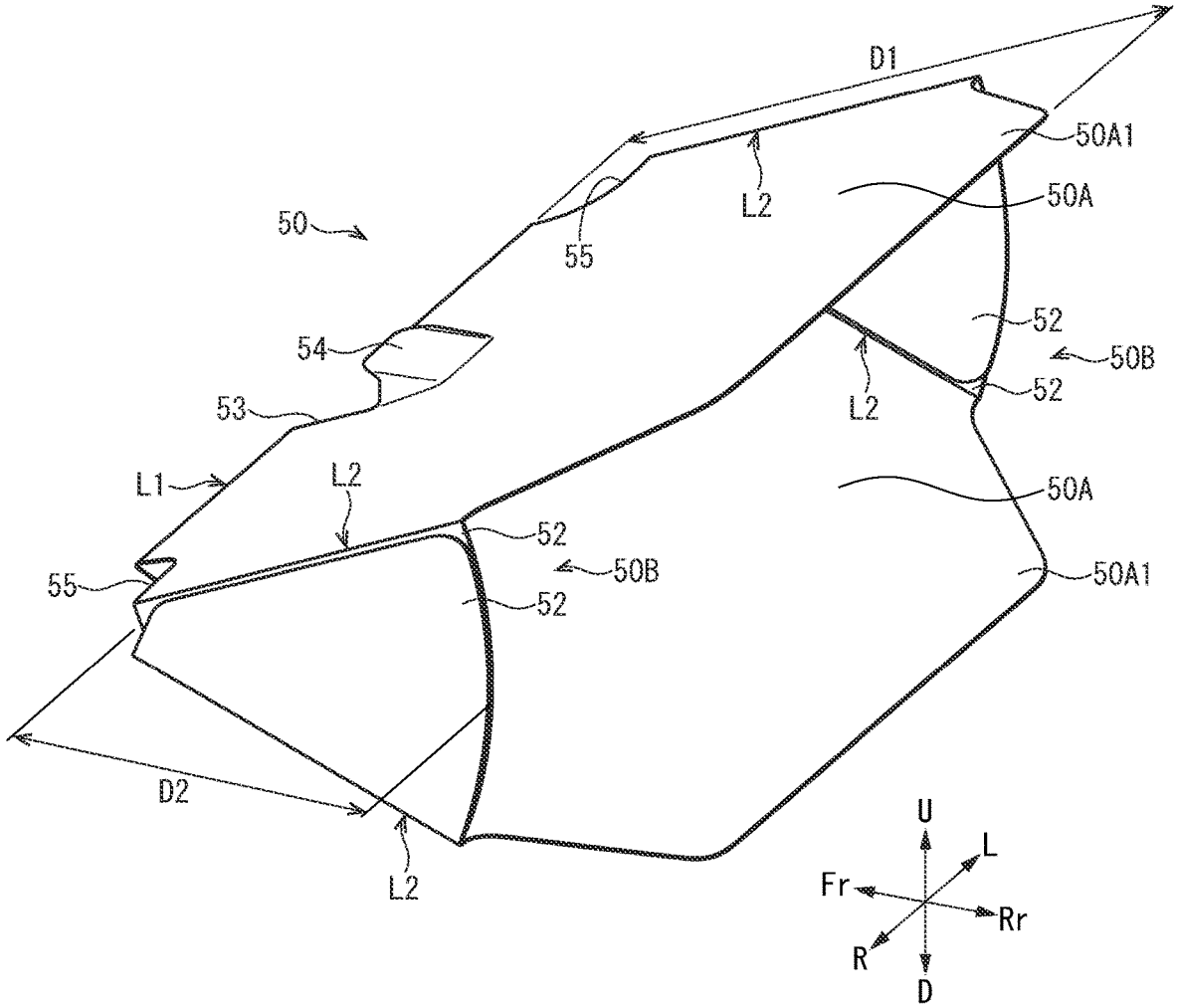
FIG. 6 is a perspective view showing a covering body of the ink pack according to the embodiment of the present disclosure.
Figure 7:
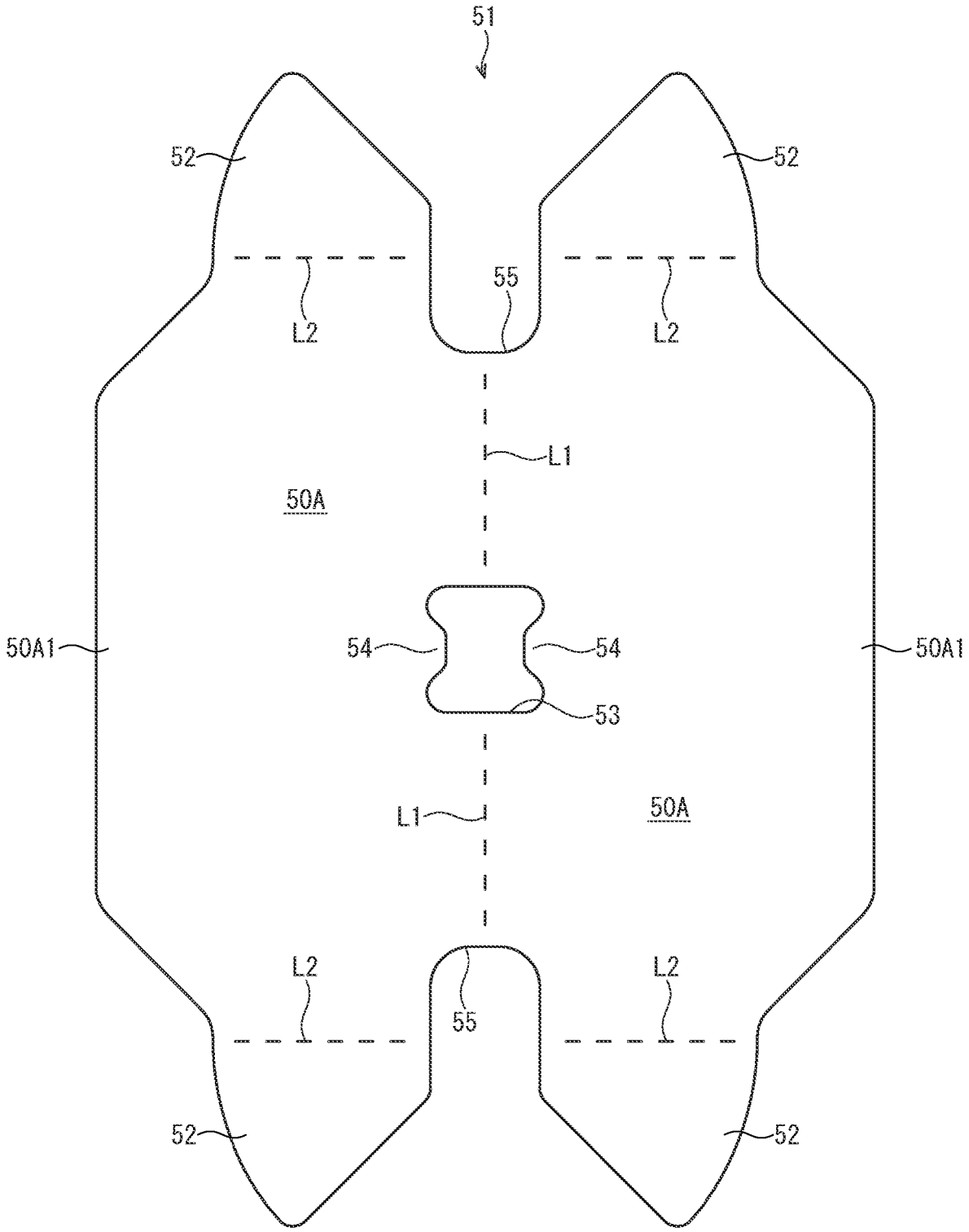
FIG. 7 is a development view showing the covering body of the ink pack according to the embodiment of the present disclosure.

[Ink Pack] With reference to FIG. 5 to FIG. 7, the ink pack 6 will be described. FIG. 5 is a perspective view showing the ink pack 6. FIG. 6 is a perspective view showing a covering body 50 of the ink pack 6. FIG. 7 is a development view showing the covering body 50 of the ink pack 6.

As shown in FIG. 5, the ink pack 6 includes a pack main body 40 and the covering body 50.

<Pack Main Body> The pack main body 40 is formed into a back shape by joining flexible films F1 and F2, and stores the ink (a liquid). The films F1 and F2 forming the pack main body 40 are each a layered film in which a plurality of layers is layered. For example, the films F1 and F2 each has a four-layer structure of a polyethylene (PE) layer, an aluminum (Al) layer, a polyamide (PA (nylon)) layer and a polyethylene terephthalate (PET) layer in the order from the inner layer to the outer layer. The films F1 and F2 is not limited to the above material and structure, and may be made by material capable of sealing light, air (odor) and moisture and being bent easily.

The pack main body 40 is formed into a back shape with gores by joining a pair of the upper and lower films F1 formed in a substantially rectangular shape and a pair of the left and right films F2 formed in a substantially hexagonal shape along their outer peripheral edges. Along the outer peripheral edges of the pack main body 40, joint parts 40A where the films F1 and F2 are overlapped and joined are formed in a belt-like shape. The films F1 and F2 are preferably joined by heat melting and pressure bonding, but the joining method is not limited to the above method, and the films F1 and F2 may be bonded using an adhesive or a double-sided tape.

The pack main body 40 has a trunk part 41 formed in a square cylindrical shape with the ink stored therein, and a pair of sealing parts 42 sealing both axial ends of the trunk part 41 in an axial direction (the front-and-rear direction) of the trunk part 41. Each of the sealing parts 42 is formed into a gabled roof shape having a pair of flat portions 42A facing each other in the thickness direction (the upper-and-lower direction) and a pair of gable portions 42B facing each other in the width direction (the left-and-right direction (a direction orthogonal to the axial direction and the thickness direction)). In a state in which the pack main body 40 is fully filled with the ink (a full state), the flat portions 42A are inclined so as to be close to each other as they separate away from the trunk part 41 in the axial direction. The flat portions 42A are joined at the tip end sides in the axial direction to form the joint parts 40A. Each of the gable portions 42B is formed in a substantially triangular shape which becomes narrower as they separate away from the trunk part 41 in the axial direction. In this specification, "facing" means not only facing each other in a parallel posture but also facing each other in an inclined posture (a posture not parallel).

In the full state, the pack main body 40 is formed such that the maximum dimension W (alternatively, the width dimension of the trunk part 41) of the flat portions 42A in the width direction is longer than the maximum dimension H (alternatively, the thickness of the trunk part 41) of the gable portion 42B in the thickness direction.

(Spout) The pack main body 40 has a spout 43 through which the stored ink is discharged. The spout 43 is made of, for example, synthetic resin and is formed into an approximately cylindrical shape. The spout 43 is attached to the tip end (the front end) of the sealing part 42 at the substantially center in the width direction. Specifically, the spout 43 is fixed to the joint part 40A while being held between the flat portions 42A. That is, the flat portions 42A are also joined to the outer surface of the spout 43.

(Supply Connection Part) The supply connection part 44 is attached to the tip end portion of the spout 43. The supply connection portion 44 is made of, for example, hard synthetic resin and is formed into a substantially rectangular parallelepiped shape long in the left-and-right direction. The supply connection part 44 has a length in the width direction shorter than the maximum dimension W of the flat portions 42A in the width direction and longer than half of the maximum dimension W. The supply connection part 44 has a thickness (a height) shorter than the thickness (H) of the trunk part 41. The spout 43 is mounted at a position shifted on the right side from the center in the width direction of the supply connection part 44. That is, the supply connection portion 44 is disposed at a position shifted on the left side from the center of the pack main body 40 (the sealing part 42).

The supply connection part 44 is provided to connect to the image forming apparatus 2 (an external apparatus). Specifically, in a state where the ink pack 6 is set in the pack attachment part 5, the supply connection part 44 is connected to the suction port member 8 (see FIG. 3). Thus, the ink pack 6 is connected to the ink supply part 30 of the image forming apparatus 2 via the supply pipe 7 and the others. The ink stored in the ink pack 6 is supplied to the discharge head 15A (a supply destination), and the discharge head 15A can discharge the supplied ink.

<Action of the Pack> In the full state, the trunk part 41 is formed into a square cylindrical shape, and each sealing part 42 is formed into a gabled roof shape. When the ink is discharged through the spout 43, the pack main body 40 changes its thickness depending on to a remaining amount of the ink. That is, as the remaining amount of the ink in the pack main body 40 decreases, the thickness (a width in the upper-and-lower direction) of the pack main body 40 gradually decreases and the pack main body 40 collapses in a flat shape. Specifically, as the ink decreases, the left and right films F2 are folded inward, and the upper and lower films F1 (the flat portions 42A) are overlapped each other in parallel. In this way, since the pack main body 40 is collapsed into an almost flat shape, the ink stored in the pack main body 40 can be effectively consumed up without leaving it. It is also possible to prevent excess air from entering the pack main body 40.

<Covering Body> As shown in FIG. 5, the covering body 50 is provided to cover a part of the pack main body 40. Specifically, the covering body 50 covers most of the front sealing part 42.

As shown in FIG. 5 and FIG. 6, the covering body 50 is formed into a gabled roof shape having a pair of covering flat plates 50A disposed so as to face the pair of flat portions 42A, and a pair of plate-shaped support parts 50B connected to the covering flat plates 50A and disposed along (facing) the pair of gable portions 42B. That is, the covering flat plates 50A are inclined to be close to each other toward the front side. The support parts 50B cause the portions of the covering flat plates 50A to which the support parts 50B are connected, to be disposed separately. Thus, the covering flat plates 50A are disposed so as to form a predetermined angle between them. Each of the support parts 50B is formed, for example, into a plate having a substantially trapezoidal shape (or a fan-like shape) whose width becomes narrower toward the front side. By forming the support part 50B into a plate, the pair of covering flat plates 50A can be hardly deformed from a state where they are disposed so as to form the predetermined angle between them.

The covering body 50 is formed such that the maximum dimension D2 of the support part 50B in the axial direction (the front-and-rear direction) is shorter than the maximum dimension D1 of the covering flat plate 50A in the axial direction. Further, each of the covering flat plates 50A has a projecting piece 50A1 projecting toward the side of the trunk part 41 (rearward). Each projecting piece 50A1 is formed in a substantially trapezoidal shape whose width gradually decreases toward the rear side.

(Plate) The covering body 50 is formed by bending or joining a plate 51 shown in FIG. 7 at suitable positions. The plate 51 constituting the covering body 50 is made of polyethylene terephthalate (PET), for example, and is formed thicker than the films F1 and F2 constituting the pack main body 40. That is, the plate 51 has a higher rigidity than the films F1 and F2. The plate 51 is more hardly deformed than the films F1 and F2. That is, the plate 51 has a deformation amount when an external force is applied than the films F1 and F2 when they are formed in the same plane shape.

As shown in FIG. 7, the plate 51 has a pair of the covering flat plates 50A and four gable plate parts 52.

The covering flat plates 50A are connected to each other through a first folding line L1 at a portion to be the front end. The covering flat plates 50A are formed into a substantially rectangular shape which is linearly symmetrical about the first folding line L1. At the center of the covering flat plates 50A in the width direction, a fitting opening part 53 is opened crossing the first folding line L1. The covering flat plates 50A have a pair of projections 54 projecting toward the inside of the fitting opening part 53. Therefore, the fitting opening part 53 is formed in a substantially H-shape. The covering flat plates 50A have a pair of side openings 55 recessed from both sides in the width direction (the left-and-right direction) toward the center. Each side opening 55 is cut into a substantially rectangular shape.

The four gable plate parts 52 are connected to both ends of the pair of covering flat plates 50A in the width direction through second folding lines L2. The four gable plate parts 52 are each formed in a substantially trapezoidal shape (a substantially fan-like shape) whose width becomes gradually narrow, toward the first folding line L1.

The first and second folding lines L1 and L2 are perforations formed by forming a plurality of notches at predetermined intervals, and are formed for folding the plate 51. The first and second folding lines L1 and L2 are not limited to the perforations, and may be lines weakened so that the plate 51 can be folded. Although not shown in the drawings, a label on which information relating to the ink is printed is adhered to the surface of the plate 51. The information may be directly printed on the surface of the plate 51.

<Assembly of the Covering Body> Next, a procedure for assembling the covering body 50 will be described. Here, as an example, a case where an operator assembles the covering body 50 by hand will be described.

The operator folds the pair of covering flat plates 50A back along the first folding line L1 to make the back surfaces face each other at a predetermined angle. Next, the operator folds the pair of gable plate parts 52 connected to one of the covering flat plates 50A at substantially right angles along the second folding lines L2 toward the other covering flat plate 50A. After that, the operator folds the pair of gable plate parts 52 connected to the other covering flat plate 50A at substantially right angles toward the one covering flat plate 50A along the second folding lines L2, and joins it to the previously folded gable plate part 52. The two gable plate parts 52 are overlapped and joined to constitute the support part 50B. It should be noted that the gable plate parts 52 may be joined by a method of heat melting and pressure bonding, or may be joined using an adhesive or a double-sided tape.

Thus, the gabled roof shaped covering body 50 is assembled (see FIG. 6). The fitting opening part 53 is opened at the front end portion (near the first folding line L1) of the pair of covering flat plates 50A, and the projections 54 project forward from the edge of the fitting opening part 53. The side openings 55 are opened at both corners of the covering body 50 in the width direction.

<Attachment of the Covering Body> Next, a procedure for attaching the covering body 50 to the pack main body 40 will be described. Here, as an example, a case where an operator attaches the covering body 50 by hand will be described. It is assumed that the covering body 50 is attached to the pack main body 40 before the supply connection part 44 is attached to the spout 43. It is assumed that the pack main body 40 is filled with the ink and the spout 43 is sealed.

The operator covers the sealing part 42 of the pack main body 40 with the covering body 50 from the front side. As shown in FIG. 5, the covering flat plates 50A are disposed so as to overlap on the flat portions 42A of the sealing part 42, and the support parts 50B are disposed so as to face the gable portions 42B of the sealing part 42. The spout 43 is exposed to the outside through the fitting opening part 53 of the covering body 50. The projections 54 projecting forward from the edge of the fitting opening part 53 hold the spout 43 protruding through the fitting opening part 53 from both upper and lower sides. In other words, the spout 43 fits into the fitting opening part 53 of the covering body 50. In other words, the covering body 50 is connected to the spout 43 (the proximal end portion of the spout 43). Both the front corner portions of the sealing part 42 are exposed to the outside from the side openings 55 of the covering body 50.

In the above manner, the covering body 50 is attached to the pack main body 40. After attaching the covering body 50 to the pack main body 40, the operator attaches the supply connection part 44 to the spout 43.

<Attachment of the Ink Pack and Action of the Covering Body> The operator opens a part (a top plate) of the exterior plate 4B of the ink supply device 3, attaches the ink pack 6 to the pack attachment part 5, and couples the supply connection part 44 of the ink pack 6 to the suction port member 8. Then, the ink stored in the ink pack 6 is supplied to the discharge head 15A (the supply destination) of the image forming apparatus 2. When the ink is consumed, the remaining amount of the ink in the pack main body 40 is decreased, and the pack main body 40 is gradually collapsed into a flat shape.

By the way, because the pack main body 40 of the ink pack 6 is formed by the flexible films F1 and F2, it is flexibly deformed (folded or recessed) owing to a force applied from the outside (an external force) even a case of the full state. If the pack main body 40 having no covering body 50 is only attached to the pack attachment part 5, when the operator who conveys the pack main body 40 or attaches (replaces) the pack main body 40 deforms the pack main body 40, the pack main body 40 may be attached to the pack attachment part with the deformed state. In this case, if the remaining amount of the ink is decreased, the pack main body 40 cannot be collapsed into a flat shape at the deformed portions. As an example, if the sealing part 42 formed into a gabled roof shape is deformed, because the sealing part 42 is not collapsed into a flat shape, the trunk part 41 is collapsed irregularly not into a flat shape. As described above, if the pack main body 40 is not collapsed into a flat shape, a problem that the ink in the pack main body 40 is not discharged through the spout 43 and remains in the pack main body 40 may occur.

For the above problem, in the ink pack 6 (a liquid container) according to the present embodiment, the covering body 50 is covered on the sealing part 42 formed into a gabled roof shape, of the pack main body 40. Because the covering body 50 has a rigidity larger than the films F1 and F2 and is hardly deformed (it is more hardly deformed than the pack main body 40), the flat portions 42A of the pack main body 40 is hardly deformed from a flat shape into a deflect shape. According to the configuration, for example, the deformation of the pack main body 40 caused by the user pushing or gripping the sealing part 42 during transportation or attachment (replacement) can be suppressed. This prevents the pack main body 40 from being attached to the pack attachment part 5 in a deformed state, so that the pack main body 40 can be collapsed into a flat shape depending on the remaining amount (a consumption amount) of the ink. As a result, the ink in the pack main body 40 can be effectively consumed up, and the ink remaining in the pack main body 40 can be reduced. When the covering body 50 is constituted such that the covering flat plates 50A are connected by the support parts 50 B, the covering flat plate 50A itself is hard to deform, and additionally, the whole covering body 50 in which the covering flat plates 50A are kept at a predetermined angle is hard to deform. Thus, the covering body 50 can maintain its own shape in comparison with the pack main body 40 regardless of the remaining amount of the ink. As a result, the ink in the pack main body 40 can be effectively consumed up, and the remaining amount of the ink in the pack main body 40 can be reduced. If the support part 50B is formed into a plate shape, the whole covering body 50 is more hardly to deform.

If the covering body 50 (the covering flat plate 50A, the support part 50B) is connected (fixed) to the flat portion 42A or the gable portion 42B of the sealing part 42, the pack main body 40 cannot be collapsed into a flat shape even if the remaining amount of the ink is reduced. On the other hand, according to the ink pack 6 according to the present embodiment, because the covering body 50 is connected to the spout 43, a suppression of the deformation of the pack main body 40 depending on the remaining amount of the ink is inhibited. Further, the sealing part 42 can be kept in a gable roof shape from a state in which the ink is full to a state in which the remaining amount of the ink is about a half, and thereafter, the pack main body 40 can be collapsed in a flat shape as the remaining amount of the ink decreases. Further, even if, for example, the user holds the covering body 50 and transports the ink pack 6, since the covering body 50 is connected to the spout 43 and does not interfere with the pack main body 40, the pack main body 40 can be hardly deformed.

Information relating to the ink or the ink pack 6 is displayed on a label adhered to the surface of the plate 51. When the label is adhered to the pack main body 40, since the portion where the label is adhered is different from the other portion in the easiness of deformation, when the remaining amount of the ink is reduced, a possibility that the pack main body 40 is collapsed in a deformed shape is increased. In the case where the label is adhered to the pack main body 40, such a possibility can be reduced by setting a length of the longest portion of the label to ½ or less, and further to ⅓ or less of the shortest width of the surface to which the label is adhered. If the label is not adhered to the pack main body 40, such possibility can be reduced.

In addition, the label may be adhered in a skewed state with respect to the surface to which the label is adhered. This results in a deformed shape of the pack main body 40. Such a deformed state increases the deformation when the remaining amount of the ink decreases. From this point of view, as described above, the label adhered to the pack main body 40 is made small, or, it is more preferable that no label is adhered to the pack main body 40.

It should be noted that the information may be printed on the pack main body 40, but this would complicate the process of manufacturing the ink pack 6 storing the ink and its management for reasons described later. Although the information showing the type of the ink is displayed on the ink pack 6, it is necessary to change the language to be displayed depending on the shipping area. In addition, since it is required to display information in accordance with laws and the like depending on the country or the area to which the ink is shipped, there are many types of information to be displayed on the ink pack 6 even when the ink of the same type is stored in the ink pack 6. When the information is printed on the pack body 40, the printing is usually performed on the sheet shaped pack main body 40 before the pack main body 40 is formed into a bag shape. That is, when the information is printed on the pack main body 40, it is necessary to prepare a large number of types of the pack main bodies 40 printed with different information, and to fill the ink therein in accordance with the information. In this way, the process and its management are complicated, and the stock of the pack main body 40 to be prepared is increased.

By the way, for example, when the ink pack 6 is dropped on the floor, because the pack main body 40 is greatly deformed by the impact caused when the ink pack 6 collides with the floor, the supply connection part 44 may relatively shift toward the pack main body 40. If the covering body 50 is not provided, there is a possibility that the supply connection part 44 directly come in contact with the sealing part 42 and damages the sealing part 42 (the pack main body 40), causing leakage of the ink. On the other hand, according to the ink pack 6 according to the present embodiment, since the covering body 50 is covered with the sealing part 42 of the pack main body 40, the supply connection part 44 is prevented from directly coming into contact with the pack main body 40. Thus, the pack main body 40 can be protected. It should be noted that the covering body 50 of the ink pack 6 according to the present embodiment covers a range in which the supply connection part 44 comes into contact with (interferes with) the pack main body 40 when the pack main body 40 is largely deformed by the impact or the like and the supply connection part 44 is relatively shifted.

When the user transports the ink pack 6, it is desirable to hold the entire ink pack 6. In this way, the pack main body 40 is hardly deformed during the transportation, and a possibility that the deformation remains when the pack main body 40 is attached on the ink supply device 3 can be reduced. However, it is conceivable for some users to hold the covering body 50 and transport the pack main body 40. In such a case, as shown in FIG. 5, if the supporting parts 50B are in a plate shape, the entire covering body 50 is hardly deformed, so that a possibility that the pack main body 40 is attached in a deformed state can be reduced. In addition, the plate-like support part 50B covers at least a part of the gable portion 42B. The range in which the support part 50B covers the gable portion 42B may be 1/10 or more, further ⅕ or more, especially ⅓ or more of the area of the gable portion 42B. In this case, the above-described deformation of the pack main body 40 can be made less likely to occur.

Furthermore, considering the shape of the sealing part 42 of the pack main body 40 and the covering body 50 and the connecting position between them, a distance (D3) from the connecting portion (for example, the most front end) of the covering body 50 to the free end (the most rear end) of the support part 50B is longer than the maximum dimension D1 in the axial direction of the covering flat plate 50A. Therefore, the deformation of the pack main body 40 is larger when the user holds the support part 50B of the covering body 50 and transports it than when the user holds the covering flat plate 50A of the covering body 50 and transports it. Therefore, according to the ink pack 6 according to the present embodiment, by forming the support part 50B shorter than the covering flat plate 50A, the deformation of the pack main body 40 when the support part 50B is held and transported can be reduced.

Further, according to the ink pack 6 according to the present embodiment, since the projecting piece 50A1 is formed so as to protrude toward the trunk part 41, the user can easily hold the projecting piece 50A1 by his finger or the like. Further, by forming the projecting piece 50A1, the area of the covering flat plate 50A can be increased, and for example, the label or the like can be easily adhered.

In the ink pack 6 according to the present embodiment, the covering body 50 is fitted and connected to the spout 43, but the present disclosure is not limited thereto. For example, the covering body 50 may be fixed to the spout 43 with an adhesive or the like. Alternatively, for example, the covering body 50 may be hooked and connected to the spout 43 by a hook (not shown). Further, for example, the covering body 50 may be connected to the joint parts 40A of the pair of flat portions 42A which are the front end portions of the sealing part 42. In this case, the covering body 50 may be connected by holding the joint part 40A between the covering plates 50, or the covering flat plate 50A may be bonded to the joint part 40A with an adhesive or the like. According to this configuration, since the covering body 50 is connected to the joint part 40A at the distal end of the pack main body 40, a suppression of the deformation of the pack main body 40 depending on the remaining amount of the ink is prevented, and the same effect as the above-described embodiment can be obtained.

In the ink pack 6 according to the present embodiment, the covering body 50 covers the front sealing part 42, but the present disclosure is not limited thereto. For example, one covering part 50 may cover the rear sealing part 42, or two covering bodies 50 may cover both the front and rear sealing parts 42 (both examples are not shown).

Further, in the ink pack 6 according to the present embodiment, the plate 51 of the covering body 50 is formed thicker than the films F1 and F2 of the pack main body 40, so that the covering body 50 is hardly deformed, but the present disclosure is not limited to this. For example, the covering body 50 (the plate 51) may be made of material harder than the films F1 and F2.

Further, in the ink pack 6 according to the present embodiment, the two gable plate parts 52 of the covering body 50 are overlapped and bonded, but the present disclosure is not limited thereto. For example, grooves to be engaged with each other may be provided in the two gable plate parts 52, and the two gable plate parts 52 may be connected by engaging the grooves (not shown) with each other.

Further, in the ink pack 6 according to the present embodiment, the covering body 50 is formed by folding one plate 51, but the present disclosure is not limited to thereto. For example, like the pack main body 40, a gabled roof shaped like covering body may be formed by joining a plurality of divided plates (not shown). In this case, it is sufficient to prepare only two gable plate parts 52.

Further, in the ink pack 6 according to the present embodiment, although the covering body 50 has the pair of side openings 55, the pair of side openings 55 may be omitted (this example is not shown).

Further, in the ink pack 6 according to the present embodiment, the covering body 50 includes the pair of covering flat plates 50A and the pair of support parts 50B, but the present disclosure is not limited thereto. For example, the pair of support parts 50B may be omitted, and the covering body 50 may include only the pair of covering flat plates 50A (this example is not shown).

Figure 8:
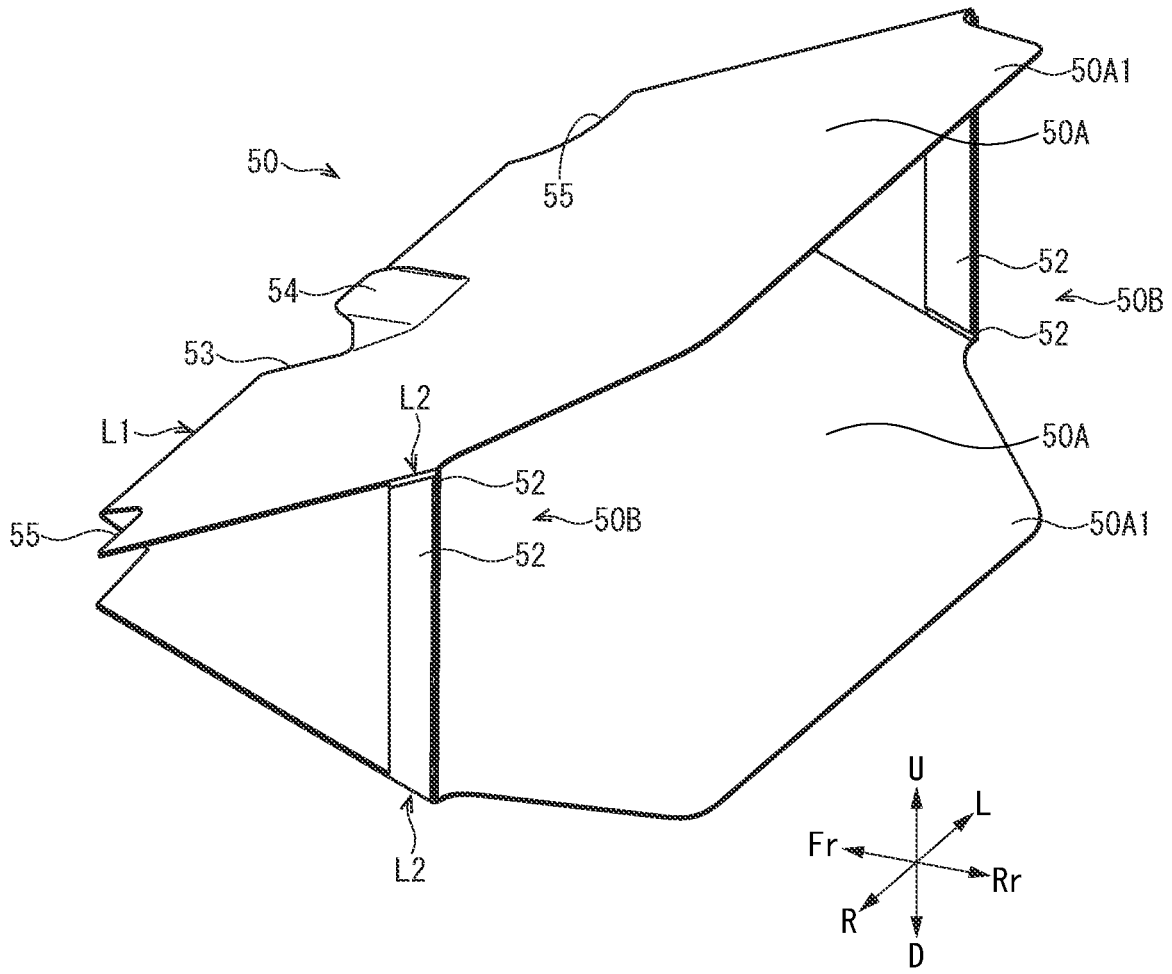
FIG. 8 is a perspective view showing a modified example of the covering body of the ink pack according to the embodiment of the present disclosure.

Further, although the ink pack 6 according to the present embodiment, the support part 50B is formed in a plate shape, it is not limited thereto, and it may be formed in a rod-like shape (or a belt-like shape) as shown in FIG. 8. In addition, the support part 50B may be formed in a rectangular columnar shape or a circular columnar shape. As one support part 50B, a plurality of rectangular columns or a plurality of circular columns may be arranged, or a plurality of rectangular columns or a plurality of circular columns may be connected to each other (the examples are not shown). Further, the support part 50B may be a mesh-like plate having holes (the example is not shown). The covering flat plate 50A may be a mesh-like shape (the example is not shown). In this case, the size of the hole may be made small such that the corners of the supply connection part 44 do not come into contact with the pack main body 40 (the sealing part 42).

Further, in the ink pack 6 according to the present embodiment, the pair of sealing parts 42 of the pack main body 40 are formed in a gabled roof shape, but the present disclosure is not limited to this. For example, the sealing part 42 which seals one end face of the trunk part 41 may be formed in a gabled roof shape, and the sealing part (not shown) which seals the other end face of the trunk part 41 may be formed in a single wall shape. That is, it is sufficient that at least one of the sealing parts 42 is formed in a gabled roof shape. In this case, the covering body 50 may cover the sealing part 42 of the gabled roof shape.

In the ink pack 6 according to the present embodiment, the spout 43 is provided at the tip end of the sealing part 42, but the present disclosure is not limited thereto. For example, the spout 43 may be provided on the trunk part 41 of the pack main body 40 (the example is not shown). In this case, the fitting opening part 53 of the covering body 50 is omitted.

Further, in the ink pack 6 according to the present embodiment, although the supply connection part 44 is connected to the spout 43, the supply connection part 44 may be omitted if the spout 43 is directly connected to the suction port member 8 (the example is not shown).

Further, although the ink pack 6 according to the present embodiment stores the ink, it is not limited to this, and may store, for example, a liquid such as a cleaning liquid used for cleaning the discharge head 15A and a storage liquid used for storing the discharge head 15A. The supply destination of the cleaning liquid is, for example, a maintenance unit for performing maintenance of the discharge head 15A.

Further, the ink pack 6 according to the present embodiment is attached to the ink supply device 3, but the present disclosure is not limited thereto. For example, the ink supply device 3 may be omitted, and the ink pack 6 may be attached to the ink supply part 30 (the container attachment part 32) of the image forming apparatus 2.

The image forming apparatus 2 according to the present embodiment is a color printer, but it is not limited thereto, and may be a monochrome printer, a copying machine, a facsimile, etc.

The description of the above embodiment shows one mode in the liquid container, the liquid supply device and the liquid discharge apparatus according to the present disclosure, and the technical range of the present disclosure is not limited to the above embodiment. The present disclosure may be changed, substituted, or modified in various ways without departing from the spirit of the technical idea, and the claims include all embodiments which may be included within the scope of the technical idea.

The invention claimed is:

1. A liquid container comprising:

a pack main body formed by bonding flexible films, and changing a thickness depending on a remaining amount of the liquid; and a covering body covering a part of the pack main body and more hardly deformable than the pack main body, wherein the pack main body includes:

a trunk part formed into a rectangular cylindrical shape in a state where the ink is stored;

a pair of sealing parts sealing both ends of the trunk part in an axial direction; and a spout provided in one of the sealing parts and through which the liquid stored in the pack main body is discharged, wherein at least one of the sealing parts is formed into a gabled roof shape having a pair of flat portions facing each other in a thickness direction and a pair of gable portions facing each other in a width direction perpendicular to the axial direction and the thickness direction, and the covering body includes a pair of covering flat plates covering at least a part of the pair of flat portions and not extending to the trunk part.

2. The liquid container according to claim 1, wherein the covering body includes a pair of support parts which connect the covering flat plates and are disposed along the pair of gable portions.

3. The liquid container according to claim 2, wherein each of the support parts is formed into a trapezoid shape whose width becomes narrower toward an end in the axial direction.

4. The liquid container according to claim 2, wherein the flat portions of the sealing part are bonded on a tip end side in the axial direction to form a joint part, and the covering body is connected to the joint part.

5. The liquid container according to claim 2, wherein the flat portions of the sealing part are bonded on a tip end side in the axial direction to form a joint part, the spout is held between the flat portions and fixed to the joint part, and the covering body is connected to the spout.

6. The liquid container according to claim 5, wherein the pack main body includes a supply connection member mounted to the spout so as to be connected to an external device.

7. The liquid container according to claim 5, wherein the pack main body is formed such that the maximum dimension of the flat portions in the width direction is longer than the maximum dimension of the gable portions in the thickness direction, and the covering body has a pair of plate-shaped support parts connecting the covering flat plates and disposed along the gable portions.

8. The liquid container according to claim 7, wherein the covering body is formed such that the maximum dimension of the support part in the axial direction is shorter than the maximum dimension of the covering flat plate in the axial direction.

9. The liquid container according to claim 8, wherein the covering flat plate has a projection piece projecting toward the trunk part.

10. The liquid container according to claim 1, wherein the covering body is formed by a single resin plate.

11. The liquid container according to claim 1, wherein information relating the liquid or the liquid container is displayed on the covering body.

12. A liquid supply device to which the liquid container according to claim 1 is attached so as to supply the liquid stored in the liquid container to a supply destination.

13. A liquid discharge apparatus comprising:

the liquid container according to claim 1; and a discharge head through which the liquid supplied from the liquid container is discharged.

14. The liquid container according to claim 1, wherein the covering body does not cover the trunk part.

15. A liquid container comprising:

a pack main body formed by bonding flexible films, and changing a thickness depending on a remaining amount of the liquid; and a covering body covering a part of the pack main body and more hardly deformable than the pack main body, wherein the pack main body includes:

a trunk part formed into a rectangular cylindrical shape in a state where the ink is stored;

a pair of sealing parts sealing both ends of the trunk part in an axial direction; and a spout provided in one of the sealing parts and through which the liquid stored in the pack main body is discharged, wherein at least one of the sealing parts is formed into a gabled roof shape having a pair of flat portions facing each other in a thickness direction and a pair of gable portions facing each other in a width direction perpendicular to the axial direction and the thickness direction, and the covering body includes a pair of covering flat plates covering at least a part of the pair of flat portions and a pair of support parts which connect the covering flat plates and are disposed along the pair of gable portions, and each of the support parts is formed into a trapezoid shape whose width becomes narrower toward an end in the axial direction.

16. A liquid container comprising:

a pack main body formed by bonding flexible films, and changing a thickness depending on a remaining amount of the liquid; and a covering body covering a part of the pack main body and more hardly deformable than the pack main body, wherein the pack main body includes:

a trunk part formed into a rectangular cylindrical shape in a state where the ink is stored;

a pair of sealing parts sealing both ends of the trunk part in an axial direction; and a spout provided in one of the sealing parts and through which the liquid stored in the pack main body is discharged, wherein at least one of the sealing parts is formed into a gabled roof shape having a pair of flat portions facing each other in a thickness direction and a pair of gable portions facing each other in a width direction perpendicular to the axial direction and the thickness direction, and the covering body includes a pair of covering flat plates covering at least a part of the pair of flat portions and disposed along the pair of flat portions.

* * * * *